US005266433A

United States Patent [19]

Ishida et al.

[11] Patent Number: 5,266,433

[45] Date of Patent: Nov. 30, 1993

[54] DEVELOPER FOR ELECTROPHOTOGRAPHY

[75] Inventors: Toshihisa Ishida, Kitakatsuragi; Tadashi Nakamura, Nara; Nobuhiko Nakano, Tenri; Kanshiro Okamoto, Yamatokoriyama; Takeaki Oouti, Shiki; Shintaro Hatano, Yamatokoriyama, all of Japan

[73] Assignee: Sharp Kabushiki Kaisha, Osaka, Japan

[21] Appl. No.: 624,108

[22] Filed: Dec. 7, 1990

[30] Foreign Application Priority Data

| | | | |
|---|---|---|---|
| Dec. 8, 1989 | [JP] | Japan | 1-319167 |
| Dec. 8, 1989 | [JP] | Japan | 1-319169 |
| Nov. 30, 1990 | [JP] | Japan | 2-340184 |

[51] Int. Cl.[5] ..... G03G 9/097

[52] U.S. Cl. ..... 430/110

[58] Field of Search ..... 430/110

[56] References Cited

U.S. PATENT DOCUMENTS

| | | | |
|---|---|---|---|
| 4,355,886 | 10/1982 | Perez et al. | 430/108 X |
| 4,912,006 | 3/1990 | Breitschaft et al. | 430/110 |
| 4,983,485 | 1/1991 | Nagaoka et al. | 430/110 |

FOREIGN PATENT DOCUMENTS

| | | | |
|---|---|---|---|
| 340928 | 11/1989 | European Pat. Off. . | |
| 3931714 | 4/1990 | Fed. Rep. of Germany . | |
| 53-81127 | 7/1978 | Japan . | |
| 57-151952 | 9/1982 | Japan . | |
| 58-40557 | 3/1983 | Japan . | |
| 58-49254 | 3/1983 | Japan . | |
| 58-152257 | 9/1983 | Japan . | |
| 177565 | 10/1984 | Japan | 430/110 |
| 217055 | 9/1986 | Japan | 430/110 |
| 294461 | 12/1986 | Japan | 430/110 |
| 166359 | 7/1987 | Japan | 430/110 |
| 62-196671 | 8/1987 | Japan . | |
| 287262 | 12/1987 | Japan | 430/110 |
| 2-18569 | 1/1990 | Japan . | |
| 2-18570 | 1/1990 | Japan . | |
| 2-73368 | 3/1990 | Japan . | |

*Primary Examiner*—Roland Martin

*Attorney, Agent, or Firm*—David G. Colin; Peter F. Corless

[57] ABSTRACT

A two-component developer for electrophotography includes a toner comprising toner particles and an external additive composed of a compound of imidazole series or an imidazole derivative. The external additive has a volume median particle size below that of the toner particles, or of 0.1 to 100 μm. The amount of external additive is 0.001 to 5% by weight based on the weight of the toner particles. As a result, scattering of toner may be prevented and the formation of fog in the background may be reduced. In addition, the electrostatic charge characteristics of the toner may be improved and the electrostatic charge rises in a satisfactory manner.

16 Claims, 3 Drawing Sheets

DEVELOPER FOR ELECTROPHOTOGRAPHY

FIELD OF THE INVENTION

The present invention relates to a developer for electrophotography used in copying machines, printers or other apparatuses adopting electrophotographic processes.

BACKGROUND OF THE INVENTION

An electrophotographic apparatus uses a single-component or a two-component developer for electrophotography (hereinafter referred to as developer). The two-component developer may be composed of e.g., toner particles and carrier particles. An external additive is usually mixed to the developer. This external additive enables to impart to the developer a polarity opposite to or homologous to the polarity of the toner particles composing the toner. For instance, surface treated silica is adopted as external additive to give to the developer a negative electrostatic charge, i.e. a polarity opposite to the toner particles of a positive electrostatic charge. The external additive employed in order to give to the developer a positive electrostatic charge, i.e. the same polarity as the toner particles of the positive electrostatic charge, is for example aluminum oxide or the like.

Some external additives are constituted by an inorganic fine powder that, in addition to the above electrostatic characteristics, possesses conductive characteristics and prevents the toner from having an excessive electrostatic charge. Some other external additives serve the purpose of improving the flowability, controlling the electrostatic charge, or preventing the formation of a toner film on the surface of a photoreceptor. For example, the above silica is often composed of hydrophobic silica that is a surface treatment agent and improves the flowability of the developer. In addition, recent hydrophobic silica enables to stabilize the electrostatic characteristics of the developer through a special treatment, as disclosed in Japanese Publication for Unexamined Patent Application No. 45457/1983 (Tokukaisho No. 58-45457).

In addition to the above surface treatment agent made of hydrophobic silica, the external additive of some developers includes abrasive particles composed of cerium oxide, chromium oxide or the like, as for example disclosed in Japanese Publication for Unexamined Patent Application No. 81127/1978 (Tokukaisho No. 53-81127). Such developers enable to prevent the formation of a toner film on the surface of the photoreceptor, as the photoreceptor is polished by the external additive.

Furthermore, the flowability may be improved, the electrostatic charge controlled and the formation of a toner film may be prevented by mixing and adding various types of external additives to the developer, as disclosed in, e.g., Japanese Publication for Unexamined Patent Application No. 151952/1982, No. 40557/1983, No. 152257/1983, and 19667/1987 (Tokukaisho No. 57-151952, No. 58-40557, No. 58-152257, and No. 62-19667).

Namely, Japanese Publication for Unexamined Patent Application No. 151952/1982 (Tokukaisho No 57-151952) discloses a developer whose electrostatic charge is controlled by mixing 0.1 to 10 parts by weight of fine powder composed of a compound of $SnO_2$ series as external additive, with 100 parts by weight of magnetic toner, to produce a single-component developer. The external additive mixed in the developer disclosed in Japanese Publication for Unexamined Patent Application No. 40557/1983 (Tokukaisho No. 58-40557) is a conductive fine powder composed of tin oxide, silver powder, nickel powder or the like, having a particle size of 0.01 to 0.5 μm. This external additive permits to prevent the developer from causing an irregular development of solid areas and stains in the background.

The developer disclosed in Japanese Publication for Unexamined Patent Application No. 152257/1983 (Tokukaisho No. 58-152257) comprises an external additive produced by granulating with a binder at least one of various agents to produce particles of about 1 to 20 times the average particle size of the toner particles. The above various agents are, for example an electrostatic charge control agent composed of a quaternary ammonium salt, nigrosine dye or the like, an agent for improving the flowability and an abrasive. In the developer disclosed in Japanese Publication for Unexamined Patent Application No. 19667/1987 (Tokukaisho No. 62-19667), the electrostatic charge is controlled by adopting an external additive composed of a low molecular weight olefin polymer comprising an electrostatic charge control agent such as nigrosine dye or other agent.

As described above, in conventional developers, the flowability is improved, the electrostatic charge is controlled, and the formation of a toner film on the surface of the photoreceptor is prevented, by adding and mixing the above various external additives.

However, neither of the external additives adopted in conventional developers is capable of boosting the electrostatic charge of the toner, making it difficult to impart a sufficient electrostatic charge to the toner. As a result, the electrostatic charge of the toner does not rise in a satisfactory manner at the start of operations in the copying machine. This happens especially when the external additive is provided in small quantity.

Besides, with the developers disclosed in Japanese Publication for Unexamined Patent Application No. 152257/1983 (Tokukaisho No. 58-152257), and No. 19667/1987 (Tokukalsho No. 62-19667), the electrostatic charge control agent attached to the surface of the granulated external additive adheres to the surface of the carrier particles. The adhesion of the electrostatic charge control agent to the surface of the carrier causes the electrostatic charge of the toner to become insufficient when the carrier and the toner collide with each other, thereby shortening the life of the developer.

Accordingly, the addition and mixing of the above-mentioned external additives enable to improve the flowability of a conventional developer, but on the other hand cause the electrostatic charge or the rise of the electrostatic charge to be insufficient. Furthermore, when the external additive comprises an electrostatic charge control agent, the adhesion of the electrostatic charge control agent to the surface of the carrier shortens the life of the developer. Also, the use of a binder to disperse the electrostatic charge control agent causes the production cost to rise and the productivity to lower. Moreover, the above external additives are unable to prevent the toner from scattering whereby fog is liable to form in the background after a small number of copies are made, due to dust within the copying machine.

SUMMARY OF THE INVENTION

An object of the present invention is to provide a developer for electrophotography capable of preventing toner from scattering and of reducing the formation of fog in the background.

Another object of the present invention is to provide a developer for electrophotography that is capable of improving the electrostatic charge of the toner and enables the electrostatic charge of the toner to rise in a satisfactory manner.

Still another object of the present invention is to provide a developer for electrophotography having a long life.

In order to achieve the above objects, a developer for electrophotography in accordance with the present invention is composed of a toner and a carrier imparting an electrostatic charge to the toner. The toner comprises toner particles and an external additive composed of a compound of imidazole series or an imidazole derivative.

According to the present invention, the compound of imidazole series or the imidazole derivative is located on the toner particles side in the triboelectric series with respect to the carrier. Rubbing with carrier particles often causes the external additive particles composed of the compound of imidazole series or the imidazole derivative, to possess an electric charge exceeding that of the toner particles. The external additive particles therefore enable the toner to possess a sufficient electrostatic charge even when for example the toner particles have a negative electrostatic charge or an insufficient electrostatic charge quantity. As a result, the developer for electrophotography permits to reduce the scattering of toner whereby the formation of fog in the background due to dust within the copying machine, may be reduced as well.

In addition, as the external additive composed of the compound of imidazole series or the imidazole derivative is not likely to adhere to the surface of carrier particles, the carrier may be protected from rapid deterioration. As the toner may be stabilized and keep a suitable electrostatic charge for a durable period, the developer for electrophotography may thus be utilized for an extended period. Furthermore, since the external additive particles are not likely to adhere to the surface of the carrier particles, they do not need to dispersed by means of a binder, and may be composed by a simple substance. As a result, the productivity may be improved and the production cost reduced.

In addition, when the volume median particle size of the external additive particles is smaller than that of the toner particles, the external additive particles can spread easily among the toner particles. The electrostatic charge that is unequal among the toner particles may be thus homogenized, and the electrostatic charge of the toner particles may be improved. As a result, the electrostatic charge of the toner particles may be stabilized and rises rapidly even during repeated development.

For a fuller understanding of the nature and advantages of the invention, reference should be made to the ensuing detailed description taken in conjunction with the accompanying drawings.

BRIEF DESCRIPTION OF THE DRAWINGS

FIG. 1 is a graph illustrating the relation between an image density and a number of times copying is performed.

FIG. 2 is a graph illustrating the relation between the formation of fog in the background and the number of times copying is performed.

FIG. 3 is a graph illustrating the relation between the electrostatic charge of a toner and the number of times copying is performed.

FIG. 4 is a graph illustrating the relation between an image density and a number of times copying is performed.

FIG. 5 is a graph illustrating the relation between the formation of fog in the background and the number of times copying is performed.

FIG. 6 is a graph illustrating the relation between the electrostatic charge of a toner and the number of times copying is performed.

FIG. 7 is a graph illustrating the relation between the image density and the number of times copying is performed.

FIG. 8 is a graph illustrating the relation between the formation of fog in the background and the number of times copying is performed.

FIG. 9 is a graph illustrating the relation between the electrostatic charge of the toner and the number of times copying is performed.

DETAILED DESCRIPTION OF THE EMBODIMENTS

Embodiment 1

Figure 1:
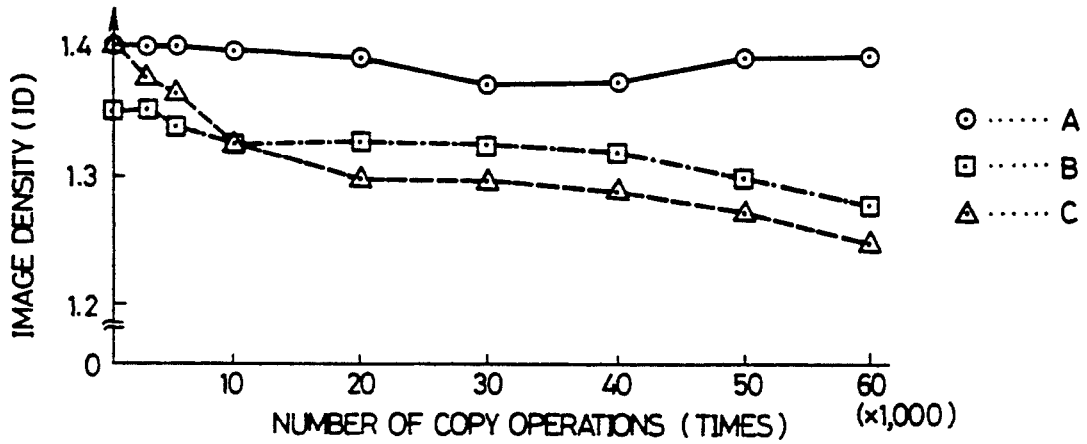
FIG. 1 to FIG. 3 illustrate an embodiment of the present invention.

A first embodiment illustrating the present invention will be discussed hereinbelow with reference to FIGS. 1 to 3.

The developer for electrophotography (hereinbelow referred to as developer) of the present embodiment is a two-component developer comprising a carrier and a toner having a positive electrostatic charge. The carrier is composed of carrier particles having a volume median particle size equal to approximately 100 μm. The carrier particles are produced by coating the particles of a magnetic powder such as iron powder, ferrite, magnetite, etc., with a silicone or an acrylic resin.

The toner is composed of toner particles having a volume median particle size equal to approximately 10 μm. The toner particles are composed of a binder for holding the various materials forming the toner particles together and for fixing a colorant on transfer paper, a colorant for imparting color to the toner, an electrostatic charge control agent for giving an electrostatic charge to the toner particles, and a surface lubricant for preventing the toner particles from adhering to fusing rollers, photoreceptor and transferring members.

The binder adopted may be a copolymer containing styrene such as polystyrene, styrene-butadiene copolymer and styrene-acrylic copolymer, a copolymer containing ethylene such as polyethylene, polyethylene-vinyl acetate copolymer, and polyethylene-vinyl alcohol copolymer, a phenol resin, an epoxy resin, an allylphthalate resin, a polyamide resin, a maleic acid resin, etc.

Known electrostatic charge control agents include amino compounds, quaternary ammonium compounds, organic dyes and in particular basic dyes and their salts. Benzyldimethyl-hexadecyl ammonium chloride, decyltrimethyl ammonium chloride, nigrosine base, nigrosine hydrochloride, safranine, crystal violet, or the like may be used. Nigrosine base and nigrosine chloride are frequently adopted as positive electrostatic charge control agent.

The colorant adopted may be, carbon black, Cu-phtalocyanine, nigrosine dyes, aniline blue, chalconyl blue, chrome yellow, ultramarine yellow, methylene blue, quinoline yellow, methylene blue chloride, phtalocyanine blue, malachite green, oxalate, lamp black, rose bengal, or a mixture of these. The toner particles should comprise an amount of colorant sufficient to produce sharp visible images.

The surface lubricant employed may be polyethylene, polypropylene, paraffin wax, or the like. These surface lubricants are extremely effective for improving the lubricative properties of the toner with respect to the fusing rollers.

An external additive is mixed to the toner composed of the toner particles comprising the above binder, colorant, electrostatic charge control agent and surface lubricant. This external additive is constituted by particles composed of a compound of imidazole series or an imidazole derivative that are located on the toner side with respect to the carrier in the triboelectric series, and in addition are not likely to adhere to the surface of the carrier particles. The particles composed of the compound of imidazole series or imidazole derivative generally have a electrostatic charge quantity exceeding that of the toner particles. Besides, as they are located on the toner side in the triboelectric series, the particles composed of the compound of imidazole series or imidazole derivative are positively charged with respect to the carrier. Mixing and thoroughly stirring the carrier particles and the toner causes both the external additive particles and the toner particles to be positively charged. Here, the electrostatic charge quantity of the external additive particles should preferably be 10 to 20 ($\mu$C/g) with respect to the toner particles having an electrostatic charge quantity equal to 12 ($\mu$C/g).

The particles composing the external additive are produced such as to have a volume median particle size smaller than that of the toner particles and equal to 0.1 to 15 $\mu$m, preferably to 0.5 to 10 $\mu$m. The optimum volume median particle size of the particles composing the external additive is 1 to 5 $\mu$m. The amount of external additive is 0.001% to 5% by weight, preferably 0.01% to 1% by weight based on the weight of the toner. Accordingly, as provision is made such that the volume median particle size of the external additive is smaller than that of the toner particles, and such that the amount of external additive does not exceed the above values, the developer enables to prevent the density of copied images from lowering due to an excessively charged toner. In addition, as provision is made such that the volume median particle size and the amount of the external additive do not fall below the above values, the electrostatic charge of the toner particles may be suitably controlled.

Known elements of the imidazole series include compounds and addition reaction products where the hydrogen atom of the imino group and imidazole were replaced by a metal atom or an alkyl group. 2 H-imidazole, 2-imidazoline, imidazolidine, pyrazole, etc. are such addition reaction products. The compounds include parabanic acid, hydantoic acid, allantoin, and glycocyamidine. Imidazole derivatives include histamine, histidine and pilocarpine. The compound of imidazole series, and the imidazole derivative may also be composed of various types of complex metals.

In addition to the external additive composed of a compound of imidazole series or an imidazole derivative, hydrophobic silica aimed at improving the flowability of the toner, conductive fine powder aimed at preventing the electrostatic charge of the developer from increasing excessively, magnetite aimed at preventing the formation of a toner film on the surface of the photoreceptor, or other additives may be mixed to the developer.

EXAMPLE 1

With the above conditions, 87 parts by weight of styrene acrylate as binder, 5 parts by weight of quaternary ammonium salt as electrostatic charge control agent, 5 parts by weight of carbon black as colorant, and 3 parts by weight of polyethylene as surface lubricant, are melted and kneaded to be homogeneously dispersed. The kneaded matter is then cooled, ground and classified to produce toner particles having a positive electrostatic charge and a volume median particle size equal to 10 $\mu$m.

Then, external additives are added to the toner particles produced through the above process. Namely, based on 100 parts by weight of toner particles, there are added: 0.2 parts by weight of hydrophobic silica; 0.3 parts by weight of magnetite; and 0.1 parts by weight of imidazole fine powder having a volume median particle size of 1 $\mu$m. The above components are mixed in a Henschel type mixer whereby the above external additives are applied to the toner particles, to produce a toner $A_1$ having a positive electrostatic charge.

Next, external additives are added to toner particles produced with the same components and composition ratio as indicated above. Namely, based on 100 parts by weight of toner particles, there are added: 0.2 parts by weight of hydrophobic silica; 0.3 parts by weight of magnetite; and 0.1 parts by weight of imidazole fine powder having a volume median particle size equal to 2 $\mu$m. The above components are mixed in a Henschel type mixer whereby the above external additives are applied to the toner particles, to produce a toner $B_1$ having a positive electrostatic charge.

Further, external additives are added to toner particles similar to the above toner particles, to produce a toner $C_1$ having a positive charge. Namely, based on 100 parts by weight of toner particles, there are added and mixed: 0.2 parts by weight of hydrophobic silica and 0.3 parts by weight of magnetite.

Then, a carrier of the ferrite series and having a volume median particle size equal to 100 $\mu$m is added to each of the toners $A_1$, $B_1$ and $C_1$. The amount of carrier is 950 g with respect to 50 g of each of the toners $A_1$, $B_1$ and $C_1$. The above elements are mixed in a Nauta mixer to produce developers A, B and C having a toner density of 5%.

Copying was repeatedly executed 60,000 times using the developers A, B and C produced as described above. The image density ID, background fog BG and electrostatic charge of the toner Q/M ($\mu$C/g) were measured when copying was started and after copying was performed 60,000 times.

Here, the above copy operation consists in projecting the image of an original upon a photoreceptor that was uniformly charged to −700 V, to produce an electrostatic latent image; then developing the electrostatic latent image by means of a magnetic brush to which a developing bias of 200 V is applied; transferring and fixing the developed electrostatic latent image onto copy paper.

The image density ID obtained with the developers A, B, and C when copying was started and after copying was performed 60,000 times, varies as illustrated in FIG. 1 and is shown in Table 1.

TABLE 1

| | Copying start | 60,000 times |
|---|---|---|
| Developer A | 1.40 | 1.39 |
| Developer B | 1.35 | 1.28 |
| Developer C | 1.40 | 1.25 |

Accordingly, between the start of copying and the 60,000th time, the image density ID varies from 1.40 to 1.39 when the developer A is adopted, and from 1.35 to 1.28 when the developer B is adopted. Meanwhile, when the developer C is employed, the image density ID varies from 1.40 to 1.25. These results clearly show that, compared to the developer C, the developers A and B permit to obtain a stable image density ID.

Figure 2:
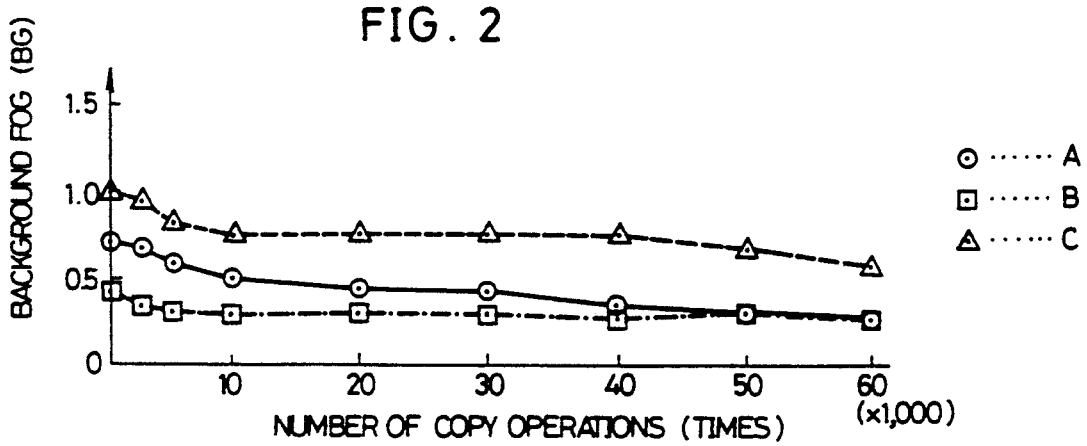

The background fog BG obtained with the developers A, B, and C when copying was started and after copying was performed 60,000 times, varies as illustrated in FIG. 2 and is shown in Table 2.

TABLE 2

| | Copying start | 60,000 times |
|---|---|---|
| Developer A | 0.70 | 0.25 |
| Developer B | 0.40 | 0.25 |
| Developer C | 1.00 | 0.56 |

Accordingly, between the start of copying and the 60,000th time, the background fog BG varies from 0.70 to 0.25 when the developer A is adopted, and from 0.40 to 0.25 when the developer B is adopted. Meanwhile, when the developer C is employed, the background fog BG varies from 1.00 to 0.56. These results clearly show that, compared to the developer C, the developers A and B permit to reduce the background fog BG.

Figure 3:
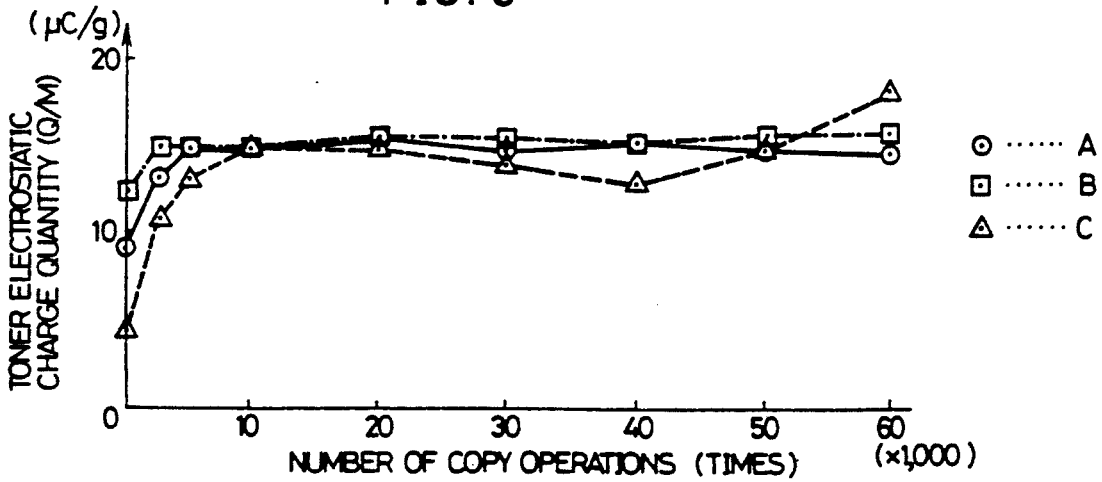

The electrostatic charge quantity of the toners Q/M respectively contained in the developers A, B, and C when copying was started and after copying was performed 60,000 times varies as illustrated in FIG. 3 and is shown in Table 3.

TABLE 3

| | Copying start | 60,000 times |
|---|---|---|
| Developer A | 9.0 | 15.5 |
| Developer B | 12.5 | 16.2 |
| Developer C | 4.8 | 18.5 |

Accordingly, between the start of copying and the 60,000th time, the electrostatic charge quantity of the toner Q/M varies from 9.0 (μC/g) to 15.5 (μC/g) when the developer A is adopted, and from 12.5 (μC/g) to 16.2 (μC/g) when the developer B is adopted. Meanwhile, when the developer C is employed, the electrostatic charge quantity of the toner Q/M varies from 4.8 (μC/g) to 18.5 (μC/g). These results clearly show that the electrostatic charge quantity of the toner Q/M is more stable in the developers A and B than in the developer C. In addition, the electrostatic charge quantity of the toner Q/M rises more rapidly in the developers A and B than in the developer C, as illustrated in FIG. 3.

Accordingly, the developers A and B, that contain the external additive belonging to the imidazole series and having a smaller volume median particle size than the toner particles, permit to obtain a more stable image density ID and toner electrostatic charge quantity Q/M than the developer C to which the external additive was not added. In addition, when the developer C is adopted, toner scattered from the developer tank after approximately 10,000 copies were made, thereby soiling the interior of the machine and causing the copies produced to be stained. However, when the developers A and B are employed, the copies produced are not stained even when copying is performed 60,000 times. This is due to the fact that the external additive particles composed of the compound of imidazole series, adhere to the toner particles having a negative electrostatic charge or a low electrostatic charge quantity thereby enabling the toner to possess a sufficient electrostatic charge quantity.

Accordingly, the addition of the external additive composed of the compound of the imidazole series or the imidazole derivative to the toner particles having a negative electrostatic charge or an insufficient electrostatic charge quantity enables to reduce the scattering of toner. As a result, the formation of fog in the background due to dust within the copying machine, may be reduced as well.

Also, it appeared clearly that the external additive, by shortening the time needed for the electrostatic charge quantity of the toner to reach a sufficient value, improves the electrostatic charge characteristics of the toner. This permits to reduce the formation of fog in the background during copying. In addition, as the volume median particle size of the external additive particles is smaller than that of the toner particles, the external additive particles can spread easily among the toner particles. As a result, the developer comprising the external additive enables the electrostatic charge to be homogeneously distributed among the toner particles, and enables the toner to have a stable electrostatic charge even during repeated development.

EMBODIMENT 2

Another example illustrating the present invention will be discussed hereinbelow with reference to FIGS. 4 to 9.

The developer for electrophotography (hereinbelow referred to as developer) is a two-component developer comprising a carrier and a toner having a positive electrostatic charge, as in the embodiment 1. The carrier is composed of carrier particles having a volume median particle size equal to approximately 80 to 120 μm. The carrier particles are produced by coating the particles of a magnetic powder such as iron powder, ferrite, or magnetite, with a silicone or an acrylic resin.

The toner is composed of toner particles having a volume median particle size equal to approximately 5 to 15 μm. The toner particles are composed of the binder, colorant, electrostatic charge control agent and surface lubricant employed in embodiment 1. An external additive constituted by particles composed of a compound of imidazole series or an imidazole derivative is mixed to the above developer. The particles composed of the compound of imidazole series or the imidazole derivative are located on the toner particles side with respect to the carrier in the triboelectric series, and in addition are not likely to adhere to the surface of the carrier particles. The compound of imidazole series or imidazole derivative generally has an electrostatic charge quantity exceeding that of the toner particles. Besides, as it is located on the toner particles side in the triboelectric series, the compound of imidazole series or imidazole derivative possesses a positive electrostatic charge with respect to the carrier.

The volume median particle size of the external additive is equal to 0.1 to 100 μm and should preferably be equal to 1 to 70 μm. The amount of external additive is 0.001% to 5%, preferably 0.01% to 1% by weight based on the weight of the toner. Accordingly, the occurrence of blocking due to a decline in the flowability of the developer, and a decrease in the density of copied images due an excessively charged toner may be prevented by making provision such that the volume median particle size and the amount of external additive do not exceed the above values. In addition, setting the volume median particle size and the amount of external additive so that they do not fall below the above values, permits to control adequately the electrostatic charge of the toner particles.

Specifically, the compound of imidazole series, or the imidazole derivative may be a 2,4-diamino-6-imidazolyl ethyl-S-triazine compound such as: 2,4-diamino-6-[imidazolyl-(1')]ethyl-S-triazine; 2,4-diamino-6-[2'-methylimidazolyl-(1')]ethyl-S-triazine; 2,4-diamino-6-[2'-ethylimidazolyl-(1')]ethyl-S-triazine; 2,4-diamino-6-[2'-undecylimidazolyl-(1')]ethyl-S-triazine; 2,4-diamino-6-[2'-heptadecylimidazolyl-(1')]ethyl-S-triazine; 2,4-diamino-6-[2'-cyclohexylimidazolyl-(1')]ethyl-S-triazine; 2,4-diamino-6-[2',4'-dimethylimidazolyl-(1')]ethyl-S-triazine; 2,4-diamino-6-[2'-ethyl-4'-methylimidazolyl-(1')]ethyl-S-triazine; 2,4-diamino-6-[2'-undecyl-4'-methylimidazolyl-(1')]ethyl-S-triazine; 2,4-diamino-6-[α-methyl-β-[2'-methylimidazolyl-(1')]]ethyl-S-triazine; etc. The compound of imidazole series, or the imidazole derivative can also be 4,4'-methylene-bis(2-alkylimidazole) such as 4,4'-methylene-bis(2-ethylimidazole) and 4,4'-methylene-bis(2-undecylimidazole); imidazole-zinc complex such as 2-heptadecyl-4-methylimidazole zinc and 2-pentadecylimidazole zinc; salts of 2-alkylimidazole and inorganic acids; and salts of 2-alkylimidazole and organic acids; etc.

In addition to the above external additive composed of a compound of imidazole series or an imidazole derivative, external additives such hydrophobic silica, conductive fine powder, magnetite or the like may also be added to the developer.

EXAMPLE 2

External additives are added to the toner particles produced as in embodiment 1. Namely, based on 100 parts by weight of toner particles, there are added: 0.2 parts by weight of hydrophobic silica; 0.3 parts by weight of magnetite; and 0.1 parts by weight of imidazole zinc complex (PLZ-1001 manufactured by Shikoku Kaseisha), composed of particles having a volume median particle size equal to 2 μm. The above components are mixed in a Henschel type mixer whereby the above additives are applied to the toner particles, to produce a toner $D_1$ having a positive electrostatic charge.

Next, based on 100 parts by weight of toner particles, there are added: 0.2 parts by weight of hydrophobic silica; 0.3 parts by weight of magnetite; and 0.1 parts by weight of an imidazole derivative (PLZ-7001 manufactured by Shikoku Kaseisha), composed of particles having a volume median particle size equal to 2 μm. The above components are mixed in a Henschel type mixer whereby the above additives ar applied to the toner particles, to produce a toner $E_1$ having a positive electrostatic charge.

Further, external additives are added to the above toner particles to produce a toner $F_1$ having a positive charge. Namely, based on 100 parts by weight of toner particles, there was added and mixed: 0.2 parts by weight of hydrophobic silica and 0.3 part by weight of magnetite.

Then, a carrier of the ferrite series and having a volume median particle size equal to 100 μm is added to each of the toners $D_1$, $E_1$ and $F_1$. The amount of carrier is 950 g with respect to 50 g of toner $D_1$, $E_1$ or $F_1$. The above elements are mixed in a Nauta mixer to produce developers D, E and F, that have a toner density of 5%.

Like in embodiment 1, copying was repeatedly executed 60,000 times using the developers D, E and F produced as described above. The image density ID, background fog BG and electrostatic charge of the toner Q/M (μC/g) were measured when copying was started and after copying was performed 60,000 times.

Figure 4:
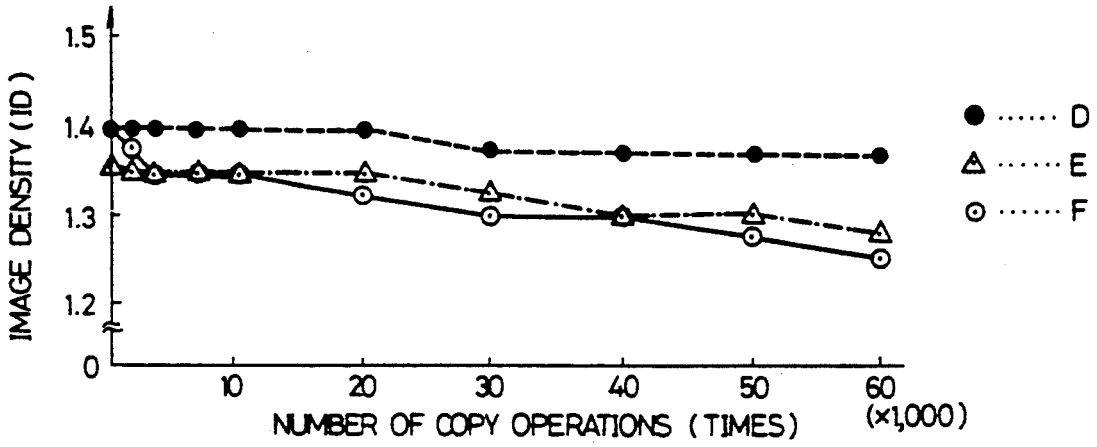
FIG. 4 to FIG. 9 illustrate another embodiment of the present invention.

The image density ID obtained with the developers D, and F when copying was started and after copying was performed 60,000 times, varies as illustrated in FIG. 4 and is shown in Table 4.

TABLE 4

| | Copying start | 60,000 times |
|---|---|---|
| Developer D | 1.40 | 1.38 |
| Developer E | 1.35 | 1.28 |
| Developer F | 1.40 | 1.25 |

Figure 5:
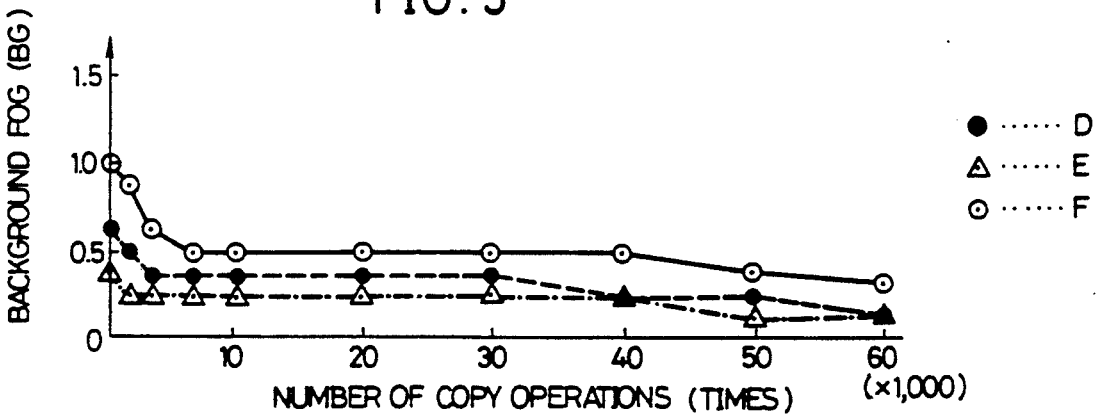

Accordingly, between the start of copying and the 60,000th time the image density ID varies from 1.40 to 1.38 when the developer D is adopted, and from 1.35 to 1.28 when the developer E is adopted. Meanwhile, when the developer F is employed, the image density ID varies from 1.40 to 1.25. These results clearly show that, compared to the developer F, the developers D and E permit to obtain a stable image density ID The background fog formed with the developers D, E, and F when copying was started and after copying was performed 60,000 times, varies as illustrated in FIG. 5 and is shown in Table 5.

TABLE 5

| | Copying start | 60,000 times |
|---|---|---|
| Developer D | 0.65 | 0.25 |
| Developer E | 0.40 | 0.25 |
| Developer F | 1.00 | 0.56 |

Accordingly, between the start of copying and the 60,000th time, the background fog BG varies from 0.65 to 0.25 when the developer D is adopted, and from 0.40 to 0.25 when the developer E is adopted. Meanwhile, when the developer F is employed, the background fog BG varies from 1.00 to 0.56. These results clearly show that, compared to the developer F, the developers D and E permit to reduce the background fog BG.

Figure 6:
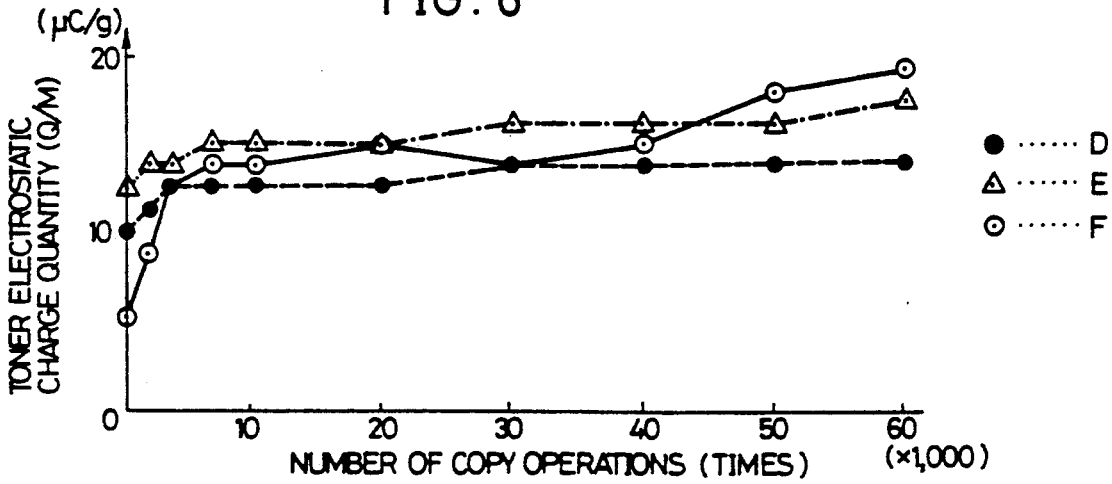

The electrostatic charge quantity of the toner Q/M contained in the developers D, E, and F when copying was started and after copying was performed 60,000 times varies as illustrated in FIG. 6 and is shown in Table 6.

TABLE 6

| | Copying start | 60,000 times |
|---|---|---|
| Developer D | 10.0 | 13.5 |
| Developer E | 12.5 | 16.2 |

TABLE 6-continued

| | Copying start | 60,000 times |
|---|---|---|
| Developer F | 4.8 | 18.5 |

Accordingly, between the start of copying and the 60,000th time, the electrostatic charge quantity of the toner Q/M varies from 10.0 (μC/g) to 13.5 (μC/g) when the developer D is adopted, and from 12.5 (μC/g) to 16.2 (μC/g) when the developer E is adopted. Meanwhile, when the developer F is employed, the electrostatic charge quantity of the toner Q/M varies from 4.8 (μC/g) to 18.5 (μC/g). These results clearly show that the electrostatic charge quantity of the toner is more stable in the developers D and E than in the developer F. In addition, the electrostatic charge quantity of the tone Q/M rises and reaches a stable value more rapidly in the developers D and E than in the developer F, as illustrated in FIG. 6.

EXAMPLE 3

External additives are added the toner particles produced like in example 2. Namely, based on 100 parts by weight of toner particles, there are added: 0.2 parts by weight of hydrophobic silica; 0.3 parts by weight of magnetite; and 0.5 parts by weight of an imidazole derivative (PLZ-7001 manufactured by Shikoku Kaseisha), composed of particles having a volume median particle size equal to 2 μm. The above components are mixed in a Henschel type mixer and the above additives applied to the surface of the toner particles, to produce a toner $G_1$ having a positive electrostatic charge. A carrier belonging to ferrite series and having a volume median particle size of 100 μm, is added and mixed to the toner $G_1$ to produce a developer G having a toner density of 5%. The amount of carrier is 950 g with respect to 50 g of the toner $G_1$.

Then, copying was consecutively executed 60,000 times using the developer G, and the developers E and F of example 2. The image density ID, background fog BG and electrostatic charge quantity of the toner Q/M (μC/g) were measured when copying was started and after copying was performed 60,000 times.

Figure 7:
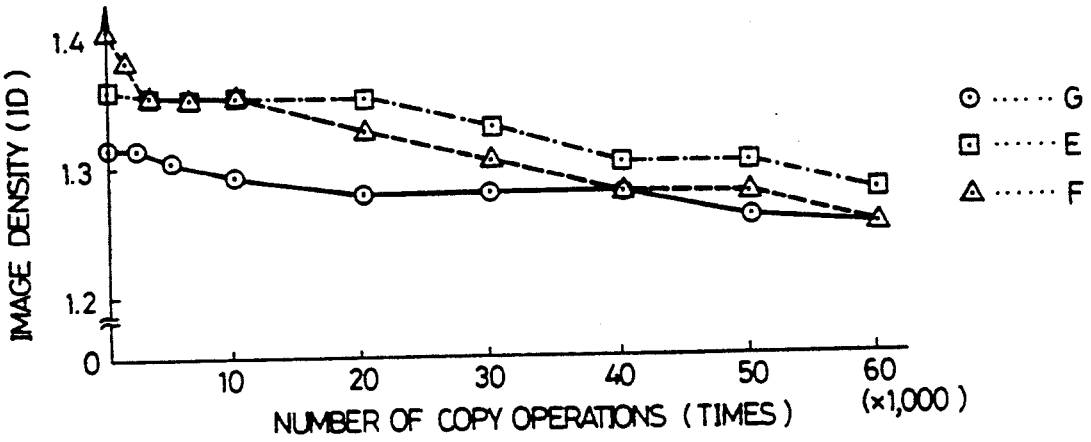

The image density ID obtained with the developers G, E and F when copying was started and after copying was performed 60,000 times, varies as illustrated in FIG. 7 and is shown in Table 7.

TABLE 7

| | Copying start | 60,000 times |
|---|---|---|
| Developer G | 1.31 | 1.25 |
| Developer E | 1.35 | 1.28 |
| Developer F | 1.40 | 1.25 |

Accordingly, between the start of copying and the 60,000th time the image density ID varies from 1.31 to 1.25 when the developer G is adopted, and from 1.35 to 1.28 when the developer E is adopted. Meanwhile, when the developer F is employed, the image density ID varies from 1.40 to 1.25. These results clearly show that, compared to the developer F, the developers G and E permit to obtain a stable image density ID.

Figure 8:
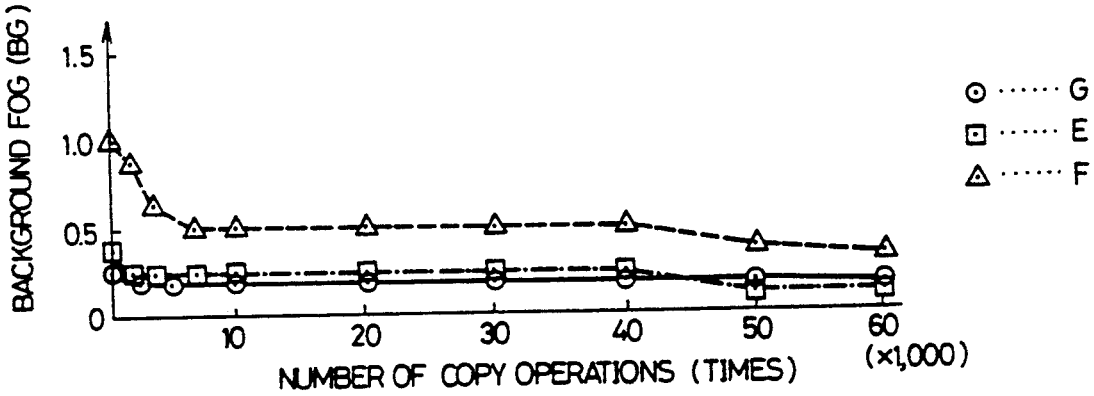

The background fog formed with the developers G, E and F when copying was started and after copying was performed 60,000 times, varies as illustrated in FIG. 8 and is shown in Table 8.

TABLE 8

| | Copying start | 60,000 times |
|---|---|---|
| Developer G | 0.25 | 0.15 |
| Developer E | 0.40 | 0.25 |
| Developer F | 1.00 | 0.56 |

Accordingly, between the start of copying and the 60,000th time, the background fog BG varies from 0.25 to 0.15 when the developer G is adopted, and from 0.40 to 0.25 when the developer E is adopted. Meanwhile, when the developer F is employed, the background fog BG varies from 1.00 to 0.56. These results clearly show that, compared to the developer F, the developers G and E permit to reduce the background fog BG.

Figure 9:
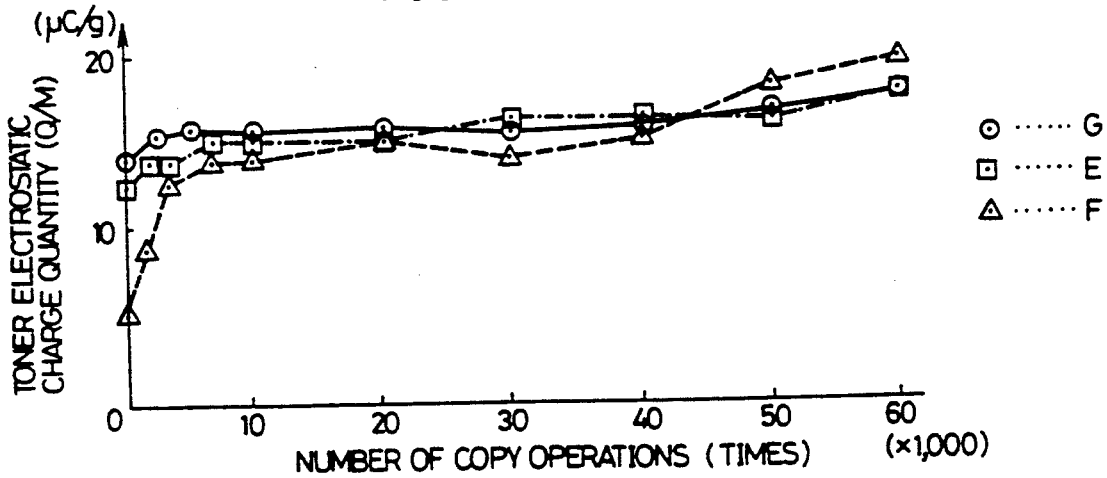

The electrostatic charge quantity of the tone Q/M contained in the developers G, E, and F when copying was started and after copying was performed 60,000 times varies as illustrated in FIG. 9 and is shown in Table 9.

TABLE 9

| | Copying start | 60,000 times |
|---|---|---|
| Developer G | 14.0 | 17.5 |
| Developer E | 12.5 | 16.2 |
| Developer F | 4.8 | 18.5 |

Accordingly, between the start of copying and the 60,000th time, the electrostatic charge quantity of the toner Q/M varies from 14.0 (μC/g) to 17.5 (μC/g) when the developer G is adopted, and from 12.5 (μC/g) to 16.2 (μC/g) when the developer E is adopted. Meanwhile, when the developer F is employed, the electrostatic charge quantity of the toner Q/M varies from 4.8 (μC/g) to 18.5 (μC/g). These results clearly show that the electrostatic charge quantity of the toner Q/M is more stable in the developers G and E than in the developer F. In addition, the electrostatic charge quantity of the toner Q/M rise and reaches a stable value more rapidly in the developers G and E than in the developer F, as illustrated in FIG. 9.

The results obtained in examples 2 and show that the developers D, E, and G that contain the external additive belonging to the imidazole series, permit to obtain a more stable image density ID and a more stable electrostatic charge quantity of the toner Q/M than the developer F to which the external additive was not added. In addition, when the developer F is adopted, toner scattered from the developer tank after approximately 10,000 copies were made, thereby soiling the interior of the machine and causing the copies produced to be stained. On the other hand, the developers G and E enable to produce unstained copies even when copying is performed 60,000 times.

As demonstrated in embodiments 1 and 2, the external additive composed of the compound of imidazole series or the imidazole derivative enables to reduce the scattering of toner and consequently the formation of fog in the background due to dust in the copying machine. This is due to the fact that the external additive composed of the compound of imidazole series or the imidazole derivative adheres to the toner particles having a negative electrostatic charge or a low electrostatic charge quantity.

Moreover, the carrier may be prevented from deterioration since the compound of imidazole series or the imidazole derivative is not likely to adhere to the surface of the carrier particles. As a result, the carrier of the developer comprising the external additive may be prevented from deterioration, thereby enabling a stable electrostatic charge to be imparted to the toner particles even in the case of repeated development.

Furthermore, the external additive is not likely to adhere to the surface of the carrier particles. Therefore, the particles composing the external additive do not need to be dispersed by means of e.g., a binder, and a stable electrostatic charge may be imparted to the toner by means of the sole external additive particles. The cost of the developer comprising the above external additive may thus be reduced, as compared to a developer comprising an external additive composed of an electrostatic charge control agent dispersed in a binder.

The invention being thus described, it will be obvious that the same may be varied in many ways. Such variations are not to be regarded as a departure from the scope of the invention.

There are described above novel features which the skilled man will appreciate give rise to advantages. These are each independent aspects of the invention to be covered by the present application, irrespective of whether or not they are included within the scope of the following claims.

What is claimed is:

1. A developer for electrophotography composed of a toner and a carrier imparting electrostatic charge to the toner, wherein the toner comprises toner particles and an external additive comprising a compound of imidazole series or an imidazole derivative that is other than a compound of the imidazole series having a metal N-substituted imino group, the toner particles having a positive electrostatic charge against the carrier, the external additive having a positive electrostatic charge against the toner particles and having a volume median particle size of 0.1 to 100 μm, the amount of the external additive being 0.001 to 5% by weight based on the weight of said toner particles.

2. The developer for electrophotography according to claim 1, wherein the external additive has a positive electrostatic charge of 10 to 20 μC/g against the toner particles having an electrostatic charge quantity equal to 12 μC/g.

3. The developer for electrophotography comprising a toner and a carrier imparting an electrostatic charge to the toner, wherein the toner comprises toner particles and an external additive, the external additive comprising particles that comprise a compound of imidazole series or an imidazole derivative having an alkyl N-substituted imino group and having an electrostatic charge exceeding that of the toner particles and being positively charged with respect to the carrier.

4. A developer for electrophotography according to claim 3, wherein the external additive has a positive electrostatic charge against the toner particles.

5. A developer for electrophotography according to claim 3, wherein the volume median particle size of said external additive is less than the volume median particle of said toner particles.

6. A developer for electrophotography according to claim 3, wherein the external additive has a volume median particle size of 0.1 to 100 μm.

7. A developer for electrophotography according to claim 3, wherein the amount of the external additive is 0.001 to 5% by weight based on the weight of said toner particles.

8. A developer for electrophotography comprising a toner and a carrier imparting an electrostatic charge to the toner, wherein the toner comprises toner particles and an external additive, the external additive comprising particles that comprise a compound of imidazole series or an imidazole derivative having an alkyl N-substituted imino group, the external additive having an electrostatic charge quantity of from about 10 to 20 μC/g against the toner particles having an electrostatic charge quantity equal to about 12 μC/g.

9. A developer for electrophotography composed of a toner and a carrier imparting an electrostatic charge to said toner, wherein said toner comprises toner particles and an external additive selected from the group consisting of imidazolidine, pyrazole, parabanic acid, hydantoic acid, allantoin, and glycocyamidine, and the volume median particle size of said external additive is less than the volume median particle size of said toner particles.

10. A developer for electrophotography as defined in claim 9, wherein the amount of the external additive is 0.001 to 5% by weight based on the weight of said toner particles.

11. A developer for electrophotography as defined in claim 10, wherein said external additive has a volume median particle size of 0.1 to 100 μm.

12. A developer for electrophotography composed of a toner and a carrier imparting an electrostatic charge to said toner, wherein said toner comprises toner particles and an external additive selected from the group consisting of histamine, histidine, and pilocarpine, and the volume median particle size of said external additive is less than the volume median particle size of said toner particles.

13. A developer for electrophotography as defined in claim 12, wherein the amount of the external additive is 0.001 to 5% by weight based on the weight of said toner particles.

14. A developer for electrophotography as defined in claim 13, wherein said external additive has a volume median particle size of 0.1 to 100 μm.

15. A developer for electrophotography comprising a toner and a carrier imparting an electrostatic charge to the toner, the toner comprising toner particles and an external additive, the toner particles having a positive electrostatic charge against the carrier, the external additive having a positive electrostatic charge against the toner particles and having a volume medium particle size of 0.1 to 100 μm, the amount of the external additive being 0.001 to 5% by weight based on the weight of said toner particles, and wherein the external additive comprises at least one compound selected from the group consisting of:

(1) a compound of the general formula

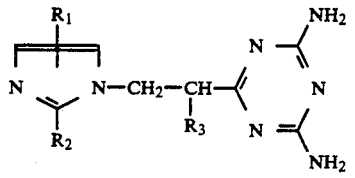

wherein $R_1$ represents a hydrogen atom or a lower alkyl group, $R_2$ represents a hydrogen atom, an alkyl group or a cycloalkyl group, and $R_3$ represents a hydrogen atom or a methyl group;

(2) a compound of the general formula

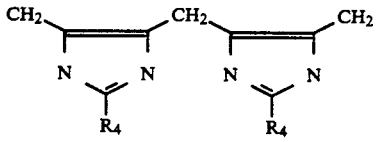

wherein $R_4$ represents an ethyl or an undecyl group;

(3) a compound of the general formula

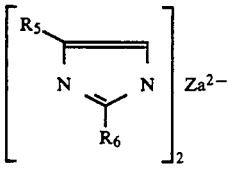

wherein $R_5$ represents a hydrogen atom or a methyl group, and $R_6$ represents an alkyl group having from 11 to 17 carbons; and (4) a compound of the general formula

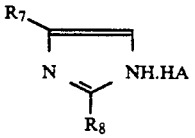

wherein $R_7$ represents a hydrogen atom or a methyl group, $R_8$ represents an alkyl group having from 11 to 17 carbons, and HA represents an inorganic acid or an organic acid.

16. A developer for electrophotography comprising a toner and a carrier imparting an electrostatic charge to the toner, the toner comprising toner particles and an external additive, the external additive comprising particles that comprise a compound of imidazole series or an imidazole derivative and having an electrostatic charge exceeding that of the toner particles and being positively charged with respect to the carrier, and wherein the external additive comprises at least one compound selected from the group consisting of:

(1) a compound of the general formula

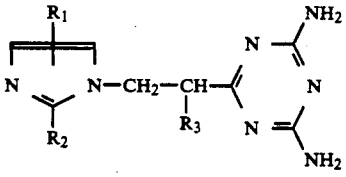

$R_1$ represents a hydrogen atom or a lower alkyl group, $R_2$ represents a hydrogen atom, an alkyl group or a cycloalkyl group, and $R_3$ represents a hydrogen atom or a methyl group;

(2) a compound of the general formula

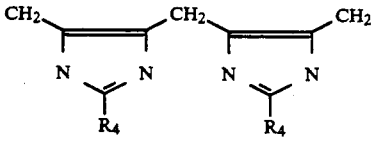

wherein $R_4$ represents an ethyl or an undecyl group;

(3) a compound of the general formula

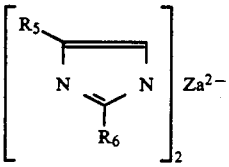

wherein $R_5$ represents a hydrogen atom or a methyl group, and $R_6$ represents an alkyl group having from 11 to 17 carbons; and (4) a compound of the general formula

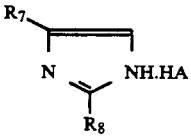

wherein $R_7$ represents a hydrogen atom or a methyl group, $R_8$ represents an alkyl group having from 11 to 17 carbons, and HA represents an inorganic acid or an organic acid.

* * * * *